US006238140B1

(12) United States Patent
Boes

(10) Patent No.: US 6,238,140 B1
(45) Date of Patent: May 29, 2001

(54) METHOD FOR LAYING TILE OR PIPE UNDERGROUND

(76) Inventor: Lanny T. Boes, 19694 T.R. 218, Fostoria, OH (US) 44830

( * ) Notice: Subject to any disclaimer, the term of this patent is extended or adjusted under 35 U.S.C. 154(b) by 0 days.

(21) Appl. No.: 09/427,214

(22) Filed: Oct. 26, 1999

Related U.S. Application Data

(60) Provisional application No. 60/105,911, filed on Oct. 28, 1998.

(51) Int. Cl.[7] ..... F16L 1/028; E02F 1/00

(52) U.S. Cl. ..... 405/183; 405/180; 405/174; 405/154; 37/367; 37/380; 37/408; 37/195

(58) Field of Search ..... 37/142.5, 195, 37/367, 379, 380, 403, 404, 408; 405/154, 174, 180, 183

(56) References Cited

U.S. PATENT DOCUMENTS

| | | | | |
|---|---|---|---|---|
| Re. 26,718 | * | 11/1969 | Kelley | 405/154 |
| 3,061,123 | * | 10/1962 | Rogers | 37/404 |
| 3,295,333 | * | 1/1967 | Killoren | 405/154 |
| 3,561,222 | * | 2/1971 | Sweeton et al. | 405/154 |
| 4,142,817 | * | 3/1979 | Lazure | 405/174 |
| 4,714,381 | * | 12/1987 | Hatch | 405/178 |
| 4,749,048 | * | 6/1988 | Kelly | 172/699 |
| 5,456,028 | * | 10/1995 | Larson | 37/404 |
| 5,601,383 | * | 2/1997 | Zanin | 405/154 |
| 5,741,088 | * | 4/1998 | Kleyman | 405/181 |
| 5,930,923 | * | 8/1999 | Nishiguchi | 37/351 |
| 6,067,733 | * | 5/2000 | Gasper | 37/367 |

* cited by examiner

*Primary Examiner*—Eileen D. Lillis
*Assistant Examiner*—Gary S. Hartmann
(74) *Attorney, Agent, or Firm*—David C. Purdue; John C. Purdue

(57) ABSTRACT

A method for burying pipe or tile and, especially, double walled drainage tile. The method comprises the steps of digging a relatively wide trench having a bottom with a desired grade and loosening the soil in a central portion of the trench bottom by pulling a groove cutter which is attached to an excavating bucket along the trench bottom so that the bucket rides on the trench bottom and the groove cutter extends below the bottom surface of the trench. After the groove cutter loosens the soil, a modified trench shield or trench box is advanced along the trench bottom. The trench shield is provided, at its leading end, with a groove shaper which removes loosened soil from the central portion of the trench and forms a relatively narrow groove in the bottom of the trench. The width of the groove, adjacent the floor of the trench, may be a little larger or smaller or equal to the drain tile diameter. As sections of the groove are completed, sections of tile are seated in the groove, connected to preceding sections, where necessary, and the trench is backfilled to bury the tile.

5 Claims, 2 Drawing Sheets

METHOD FOR LAYING TILE OR PIPE UNDERGROUND

This application claims benefit of Provisional application 60/105,911, filed Oct. 28, 1998

BACKGROUND OF THE INVENTION

1. Field of the Invention

This invention is a method for laying or burying tile or pipe underground.

2. Description of the Prior Art

People have been digging trenches and laying tile in them for many, many years. It is common practice to dig a trench, partially fill it with gravel, lay tile on top of the gravel and back fill the trench with gravel and or dirt. Some rather elaborate devices for digging a trench, laying a gravel bed and backfilling the trench are shown in U.S. Pat. Nos. 4,714,381, 4,742,646 and 5,145,290, the disclosures of which are incorporated herein by reference.

Generally speaking, the patents disclose the use of a back hoe to dig a trench with a bottom conforming substantially to a desired grade. The bottom of the trench is scraped to perfect the grade and a piece of pipe is supported in the trench, a given distance above the trench bottom. Fill, in the form of gravel, is dispensed into the trench, so that it surrounds the pipe and permanently supports it in the trench.

SUMMARY OF THE INVENTION

The present invention is a method for burying pipe or tile underground and the method is especially well suited for use in burying double walled plastic drainage tile having a diameters of about eight inches and larger. The method comprises the steps of digging a relatively wide trench having a bottom with a desired grade and loosening the soil in a central portion of the trench bottom by pulling a groove cutter which is attached to an excavating bucket along the trench bottom so that the bucket rides on the trench bottom and the groove cutter extends below the bottom surface of the trench. After the groove cutter loosens the soil, a modified trench shield or trench box is advanced along the trench bottom. According to the invention, the trench shield is provided, at its leading end, with a groove shaper which removes loosened soil from the central portion of the trench and forms a relatively narrow groove in the bottom of the trench. Depending upon the diameter of the drain tile to be placed in the trench, the width of the groove, adjacent the floor of the trench, will be a little larger or smaller or equal to the drain tile diameter. As sections of the groove are completed, sections of tile are seated in the groove, connected to preceding sections, where necessary, and the trench is backfilled to bury the tile.

DETAILED DESCRIPTION OF THE PREFERRED EMBODIMENT

Figure 1:
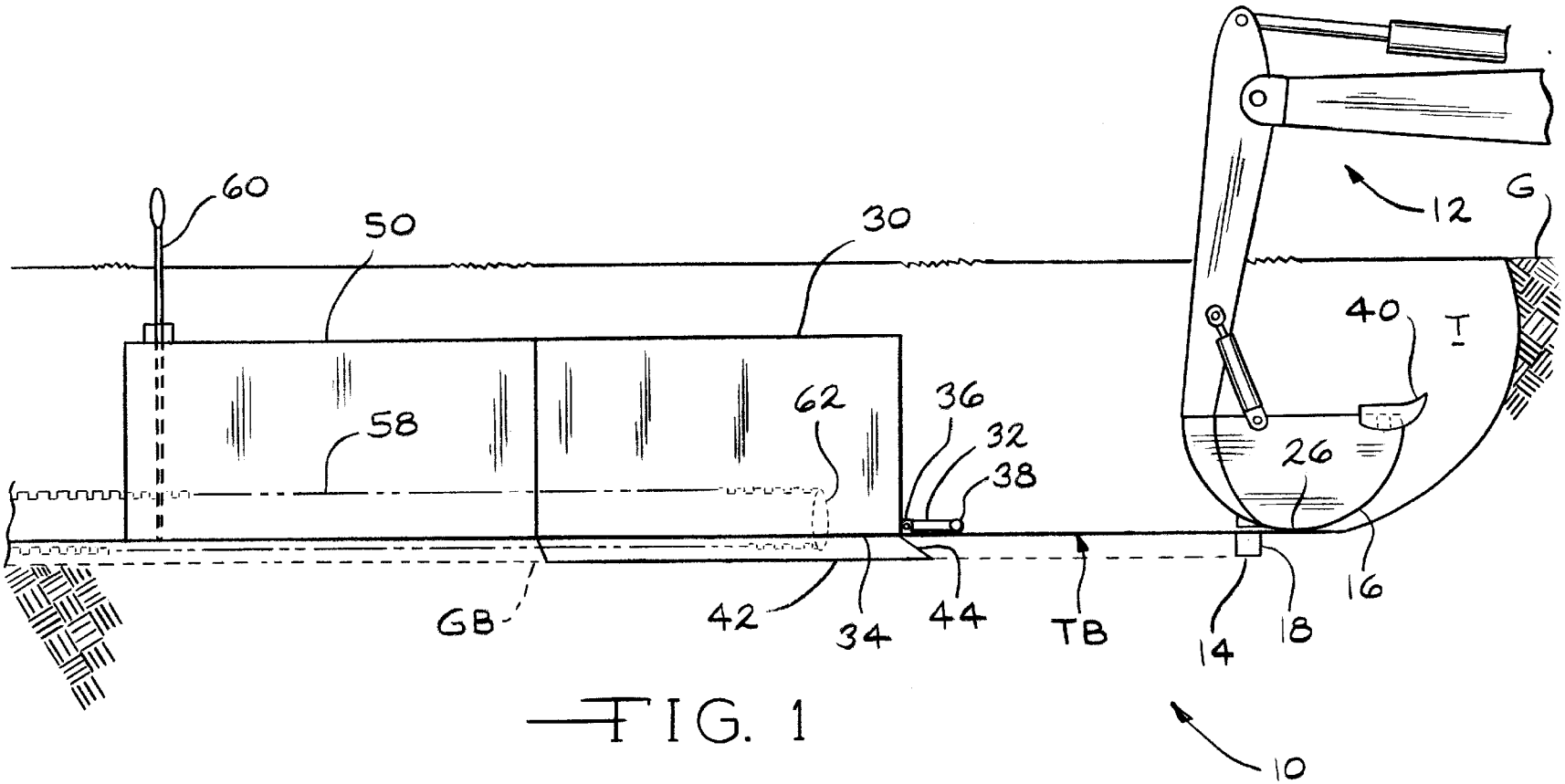
FIG. 1 is a side view of apparatus useful for carrying out the method of the present invention.

Referring now to FIG. 1, apparatus useful in carrying out the present invention is indicated generally at 10. A backhoe, excavator, digging machine or the like, a portion of which is indicated at 12, is supported substantially at ground level which is indicated at G. A bucket 14 of the backhoe is used to dig a trench T having substantially flat bottom indicated at TB. The trench bottom TB has a desired grade which is controlled through a state of the art laser system associated with the backhoe 12. The trench T, it will be appreciated, will be dug in sections, the length of a given section depending primarily upon the capacity and size of the backhoe, excavator, digging machine or the like. Once a section of trench is dug, a groove cutter 14, illustrated in FIG. 1 as attached to a bucket 16 of the backhoe or the like 12, is inserted into the ground below the trench bottom TB and advanced, in the set up illustrated in FIG. 1, from left to right. The leading edge 18 of the groove cutter 14 is preferably sharpened.

Figure 2:
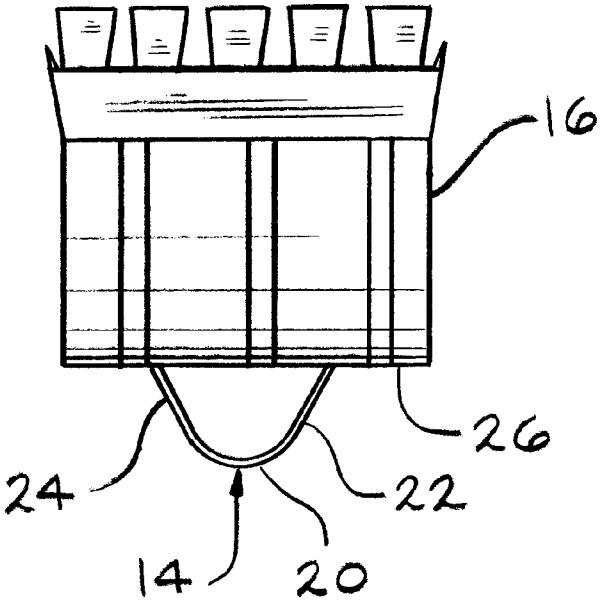
FIG. 2 is a front view of an excavator bucket with a groove cutter, according to the invention, secured thereto.

Referring now to FIG. 2, the groove cutter 14 and the bucket 16 are illustrated as they would appear to one looking to the left in FIG. 1. The groove cutter has a generally V-shaped profile with a rounded bottom portion 20 and upwardly extending legs 22 and 24 which flare outwardly somewhat. The groove cutter 14 is securely fastened to the bucket 16 as by welding or the like so that the groove cutter 14 extends rigidly downwardly from a bottom portion 26 of the bucket 16 when the bucket 16 is positioned substantially as shown in FIG. 1. The groove cutter 14 has a width, where it meets the bottom portion 26 of the bucket 16, which is substantially narrower than the width of the bucket 16. With the bucket 16 oriented as it is in FIG. 1, the bottom portion 26 can ride on the graded trench bottom TB with the groove cutter extending below the trench bottom TB, where it loosens soil in a central portion of the trench bottom TB. Once the groove cutter has loosened soil in the central portion of the trench bottom in a given section, soil is removed from the central portion, as described below, to form a groove in the trench bottom.

Figure 3:
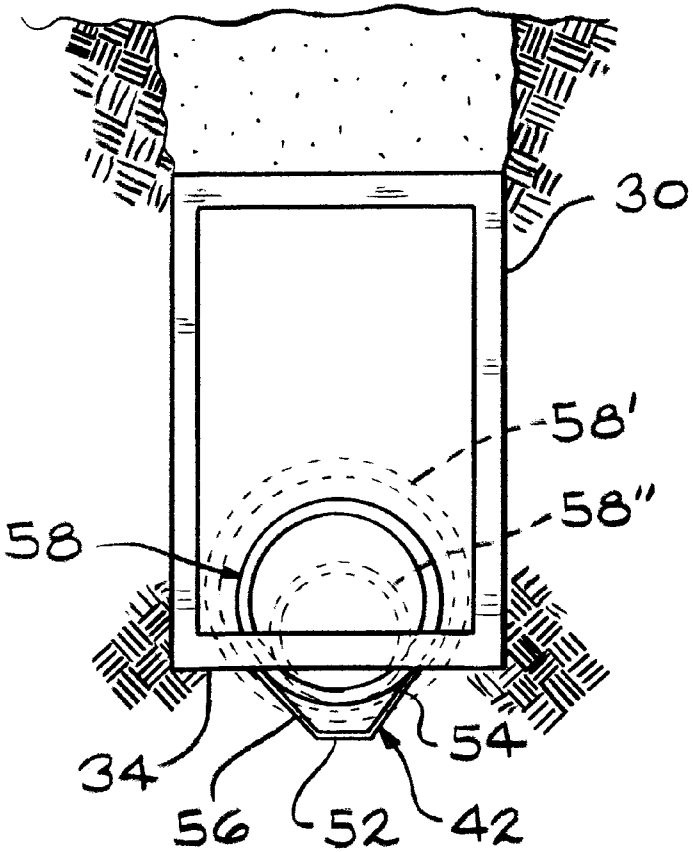
FIG. 3 is a front view of trench shield showing a groove shaper according to the present invention.

A first trench shield 30 is positioned in the trench T. At the leading edge of the trench shield, there is a puller bar 32 positioned near a lower edge 34 of the trench shield 30. Preferably, the puller bar 32 is hingedly connected, as at 36, to the trench shield 30. The puller bar 32 includes a yoke 38 which is easily engaged by teeth 40 on the bucket 16 so that the backhoe 12 or the like may pull the trench shield from left to right in FIG. 1. Below the lower edge 34 of the trench shield 30, there is a groove shaper 42 which is designed to remove loosened soil from the central portion of the trench T and to leave a groove in the trench bottom TB corresponding generally with the profile of the groove cutter 42 as shown in FIG. 3. The lower edge 34 of the trench shield 30 rides on the trench bottom TB while the groove shaper rides below the trench bottom. The front of the groove shaper is closed by a plate, indicated at 44, which causes loosened dirt in the central portion of the trench to be lifted out of the groove.

A second trench shield 50 is secured to the first trench shield 30 and is pulled along with it. Preferably, in the case where the method of the invention is employed to lay twenty foot sections of double wall polymer based drainage tile, such as Dual-Wall which is available under that name from Haviland Tile, the shields 30 and 50 are each approximately eleven feet long. In any case, the shields 30 and 50, or a single shield in the case where a single shield is used, will have a length which is slightly longer than the length of the tile sections.

The groove shaper 42, as shown in FIG. 3, has a flat bottom portion 52 and V-shaped sidewalls 54 and 56. Once the method has been employed to provide a groove with a groove bottom GB, centrally located in the trench T, corresponding in length with a section of tile 58, a section of tile is placed into the groove in the central portion of the trench T, through the tops of the trench shields 30 and 50. In case it is a second or subsequent piece of tile, a fork shaped device 60 which is secured to the second shield 50, near the trailing edge thereof, is operable to lock the trailing end (not shown) of the just-placed tile into a leading end 62 of a previously placed tile 58. As the trench shields 30 and 50 are advanced in the trench T, the trench adjacent to the trailing edge of the second trench shield is backfilled as by a bulldozer or other suitable means, leaving a buried section of tile securely in place. The just described process is repeated until a desired length of drainage tile has been buried on the site.

In the case of a tile or pipe having a diameter corresponding with that of tile or pipe 58 shown in FIG. 3, and a groove cut by a groove shaper corresponding with groove shaper 42, the tile or pipe 58 will be supported by the upper edges (not shown) of tile V-shaped side walls which define the groove produced by the groove shaper. The same will be true for a tile or pipe, indicated at 58' in FIG. 3, which has a diameter greater than the diameter of the tile or pipe 58. In the case of tile or pipe, indicated at 58" in FIG. 3, having a diameter smaller than the diameter of tile or pipe 58, the tile or pipe 58" will be supported by the V-shaped side walls (not shown) which define the groove produced by the groove shaper 42.

It will be appreciated that the method described in the foregoing detailed description is susceptible of modification within the spirit and scope of the present method for burying drainage tile and such modifications as would occur to those skilled in the art are expressly included in this description.

I claim:

1. A method for burying pipe or tile underground, said method comprising the steps of digging a trench of a given width having a bottom with a desired grade, loosening the soil in a central portion of the trench bottom by pulling a groove cutter along the trench bottom with the groove cutter extending below the bottom of the trench, advancing a trench shield which is provided, at a leading end of the trench shield, with a groove shaper, along the trench bottom so that the shaper removes loosened soil from the central portion of the trench and forms a groove in the bottom of the trench, wherein said groove is narrower than said given width and wherein said groove is defined by spaced apart, V-shaped side walls, seating sections of tile or pipe in the groove so that said tile or pipe is supported either by said V-shaped side walls or, in the case of a larger tile or pipe, is supported by an upper edge of each of said side walls, connecting the sections to preceding sections, as necessary, and back filling the trench to bury the tile or pipe.

2. The method claimed in claim 1 wherein the groove cutter is supported on a bucket and a portion of the bucket is dragged along the trench bottom while the soil is loosed in the central portion of the trench whereby the depth of the groove is substantially constant.

3. The method claimed in claim 1 wherein the widest width of the groove is wider than the diameter of the tile or pipe.

4. The method claimed in claim 1 wherein the widest width of the groove is narrower than the diameter of the tile or pipe.

5. The method claimed in claim 1 wherein the bottom of the groove, after it is shaped by the groove shaper, is flat.

* * * * *